US005285658A

United States Patent [19]

Altman et al.

[11] Patent Number: 5,285,658

[45] Date of Patent: Feb. 15, 1994

[54] EMBROIDERED LACE BRACELETS

[76] Inventors: Bruce Altman, 2500 Hudson Ter., Ft. Lee, N.J. 07029; Andrew Jiritano, 910 22 St., Union City, N.J. 07087

[21] Appl. No.: 940,033

[22] Filed: Sep. 3, 1992

Related U.S. Application Data

[62] Division of Ser. No. 720,944, Jun. 25, 1991, Pat. No. 5,156,022.

[51] Int. Cl.[5] ..... A44C 25/00

[52] U.S. Cl. ..... 63/3; 2/338; D2/635

[58] Field of Search ..... D2/624, 625, 635; 2/243 B, 244, 311, 312, 338; 63/3, 4, 11, 21; D11/3, 4, 5, 6, 200

[56] References Cited

U.S. PATENT DOCUMENTS

| | | | |
|---|---|---|---|
| D. 60,608 | 3/1922 | Dill | D2/635 |
| D. 87,423 | 7/1932 | Sachs | D2/635 |
| D. 87,731 | 9/1932 | Silverman et al. | D2/635 |
| D. 97,959 | 12/1935 | Richtmyer | D2/635 |
| D. 121,459 | 7/1940 | Bry | 2/244 |
| D. 138,617 | 8/1944 | Lichtenstein | D2/635 |
| D. 240,649 | 7/1976 | Ashworth | D11/3 |
| 2,009,325 | 7/1935 | Sachs | 2/338 |
| 2,471,165 | 5/1949 | Nachman | 2/244 |
| 3,153,244 | 10/1964 | Lowney, Jr. | 2/244 |

*Primary Examiner*—Peter M. Cuomo
*Assistant Examiner*—Michael J. Milano
*Attorney, Agent, or Firm*—Weingram & Zall

[57] ABSTRACT

An embroidered lace bracelet is provided wherein the bracelet includes a fastening means for fastening the ends of the bracelet together and the fastening means is embroidered as part of the bracelet during the embroidery of the bracelet. In a preferred embodiment, the bracelet is adapted to receive a conventional buckle means while in other embodiments the bracelet may be passed through a loop embroidered into the bracelet, during the embroidery of the bracelet and tied-off, or passed through a loop extending from the bracelet, embroidered during the embroidery of the bracelet, which loop must be folded against the bracelet and an end of the bracelet passed therethrough to fasten the bracelet about the wrist of the wearer.

4 Claims, 3 Drawing Sheets

EMBROIDERED LACE BRACELETS

This is a divisional of copending application Ser. No. 07/720,944 filed on Jun. 25, 1991, now U.S. Pat. No. 5,156,022.

FIELD OF THE INVENTION

This invention relates to embroidered bands, particularly to embroidered bracelets which include fastening means, or a means for attaching a fastening means, i.e., a buckle, for fastening the ends of the bracelet together, wherein the fastening means is embroidered as part of the bracelet during the embroidery of the bracelet.

BACKGROUND OF THE INVENTION

Bracelets have long been worn by people for a number of reasons including adornment of the persons hands and limbs, identification of a person, identification of something with which the person is associated, as an indication of a person's status, etc. As such, bracelets range from very inexpensive for bracelets of common materials such as cotton cloth, to bracelets that are made of very valuable materials such as gold, silver, etc., which are very expensive.

While some bracelets are of the "bangle" variety formed of a continuous band, many others are of the variety wherein the ends of the bracelet must be attached together after the bracelet is put around a person's wrist. A benefit of this attachable-type bracelet is that generally a better fit is provided to the wearer. Means for attachment of the ends of bracelets range from intricate clasps of precious materials to very inexpensive means including the mere tying of the two ends of the bracelet together in a knot.

RELATED ART

This invention provides a relatively inexpensive means for attachment of the ends of a bracelet together around the wrist of a wearer. Particularly, this invention provides fastening means for an embroidered lace bracelet wherein the fastening means is embroidered, as part of the bracelet during the embroidery of the bracelet. This invention thereby saves time and money during manufacturing because little or no post-embroidery manufacture is needed to provide a finished product. Further, the fastening means of the embroidered lace bracelets of this invention are relatively easy to operate and provide a rather secure fastening of the ends of the bracelet.

Previous patents have taught various means for manufacturing bracelets, various manufactured bracelets, and various means for attachment of the ends of bracelets. However, none of these patents, taken either singly or in combination, are thought to provide the benefits of the present invention.

Dill, U.S. Pat. No. Des. 60,608, discloses an ornamental design for a belt that includes a means for securing an elongated loop to the end of the belt.

Kreisler, U.S. Pat. No. Des. 71,281, discloses the ornamental design for a bracelet.

Miller, U.S. Pat. No. Des. 97,548, discloses the ornamental design for metallic fabric for jewelry.

Sachs, U.S. Pat. No. Des. 87,423, discloses the ornamental design for a belt, the salient features residing in a plaited belt strap of contrasting colors comprising a relatively wide central strip of one color and a narrow interlaced inner and outer side strips of a contrasting color, the cuter side straps forming marginal loops in straight transverse portions.

Sachs, U.S. Pat. No. Des. 92,030, discloses the ornamental design for a belt.

Richtmyer, U.S. Pat. No. 97,958, discloses the ornamental design for a belt having braided edges.

Manning, U.S. Pat. No. Des. 99,517, discloses the ornamental design for a belt, the dominant feature residing in the plurality of central longitudinally disposed connected cords which are unconnected at intervals adjacent the buckle engaging end.

Manning, U.S. Pat. No. Des. 99,954, discloses the ornamental design for a belt, the dominant feature residing in the single apertured spatulate buckle carrying end, in connection with a longitudinal series of spaced apart open loop members along its other end, which are designed to receive a portion of the buckle.

Richtmyer, U.S. Pat. No. Des. 105,408, discloses the ornamental design for a belt having braided edges.

Du Bois, U.S. Pat. No. Des. 141,753, discloses the ornamental design for a wrist watch strap having a plurality of holes at each end and a pair of rivet members which may be removably inserted through corresponding apertures at opposite ends of the strap when the strap is placed around the wrist to fasten the strip around a wrist.

Geisenheimer, U.S. Pat. No. 698,005, discloses a belt provided at each with a series of parallel transverse slots, removable tongues having enlarged rear ends interwoven through the slots, and means for connecting the front ends of the tongues together comprising a buckle and apertures for accepting the needle of a buckle.

Miller, U.S. Pat. No. 1,100,389, discloses a safety device to be used in connection with a fastening means for joining together the ends of an article of jewelry. The device is used, typically, with an article of jewelry in the form of a bracelet being made of interwoven metallic strands which are braided together. The middle row of interstices formed in the braided band serve as selectable receiving openings for the tongue of the belt buckle.

Del Noce, U.S. Pat. No. 2,833,128, discloses a braid for use in making jewelry, particularly bracelets, rings, and the like.

Polzin, U.S. Pat. No. 2,871,592, discloses an identification bracelet, the ends of which may be securely fastened together with a snap fastener attached to one end of the bracelet having cooperating male and female elements which fasten together within longitudinally spaced holes provided along the one end of the bracelet.

Baumgartner, U.S. Pat. No. 3,106,028, discloses an identification band of a unitary plastic construction that is perforated with a plurality of tongue holes spaced along the center line of the bracelet for substantially the entire length. The tongue holes coact with a buckle to provide a unidirectionally adjustable locking bracelet.

Levy, U.S. Pat. No. 4,543,672, discloses a belt that can be used with or without a separate buckle. Also disclosed is a method of tieing the belt.

The related art does not teach or suggest the essential elements of the present invention, nor does any disclose the efficiency provided by the present invention.

SUMMARY OF THE INVENTION

The present invention relates to embroidered lace bracelets wherein the fastening means for attachment of the ends of the bracelet together, around a wearer's wrist, is embroidered during the embroidery of the bracelet. This invention thereby increases production efficiency because a wearable bracelet is produced with the need for little or no post-embroidery manufacture.

In one embodiment, the embroidered lace bracelet is embroidered with reinforced apertures extending along the center of the bracelets at the end portions of the bracelets. The apertures are embroidered and reinforced during the embroidery of the bracelet. A clasp means comprising a clasp frame, a center member, and a pivoting pin may be attached to one end of the bracelet. The end of the bracelet is inserted through the clasp frame, the pivoting pin is inserted through embroidered aperture and the embroidered bracelet withdrawn from the clasp frame and fastened to itself around the center member. The other end of the embroidered bracelet may then be inserted into the clasp means with the pivoting pin cooperating with an embroidered aperture to fasten the embroidered bracelet around a wearer's wrist.

In another embodiment, the embroidered lace bracelet is embroidered with an eye at one end of the bracelet during the embroidery of the bracelet. The eye is of a size sufficient to allow the passage of the other end of the bracelet therethrough. The bracelet is fastened about a wearer's wrist by extending the second end of the bracelet through the eye and tying it off, typically by means of an overhand knot.

In another embodiment of the present invention, an embroidered lace bracelet includes a loop extending outward from one end thereof. The loop is embroidered with the bracelet during the embroidery of the bracelet. The loop contains an oblong aperture that extends parallel to the longitudinal axis of the embroidered lace bracelet. The loop may be folded up against the lace bracelet such that the aperture is positioned perpendicularly to the longitudinal axis of the bracelet and the ends of the bracelets may be passed therethrough to fasten the bracelet about the wrist of a wearer.

In all embodiments of the present invention, a fastening means for a bracelet is embroidered during the embroidery of the bracelet. This reduces and/or eliminates post-embroidery manufacture and therefore minimizes the cost of production of the bracelet while permitting it to be fastened about the wearer's wrist in a secure, fashionable, and attractive manner.

Accordingly, it is an object cf the present invention to provide a method of manufacturing a bracelet wherein the means for attachment of the ends of the bracelet together are manufactured during the manufacture of the bracelet.

It is another object of this invention to provide a bracelet wherein the fastening means is embroidered as part of the bracelet itself.

It is an additional object of this invention to provide a fastening means for an embroidered lace bracelet wherein the fastening means is embroidered as part of the bracelet during the embroidery of the bracelet.

It is yet another object of this invention to provide a bracelet which requires no post-embroidery work to provide a fastening means therefore.

It is still another object of this invention to provide a fastening means for an embroidered bracelet which is relatively inexpensive and relatively convenient to manufacture.

These, as well as further objects and advantages of this invention, will become apparent to those skilled in the art from a review of the accompanying detailed description of the preferred embodiment, reference being made to the accompanying drawings.

DETAILED DESCRIPTION OF THE PREFERRED EMBODIMENT

DETAILED DESCRIPTION OF THE PREFERRED EMBODIMENTS

Figure 1:
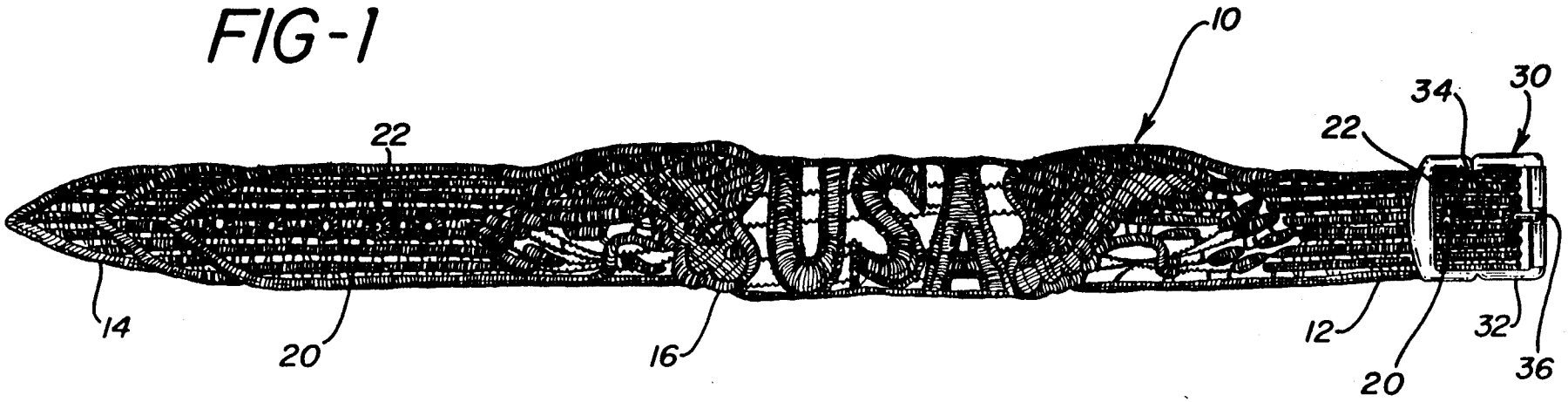
FIG. 1 is a top plan view of one embodiment of the embroidered lace bracelet of the present invention.
Figure 3:
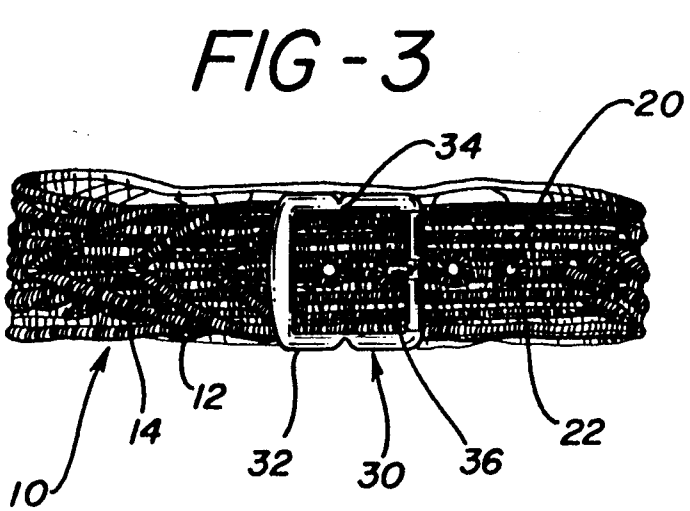
FIG. 3 is a perspective view of the embroidered lace bracelet of FIG. 1 in a fastened positioned.
Figure 2:
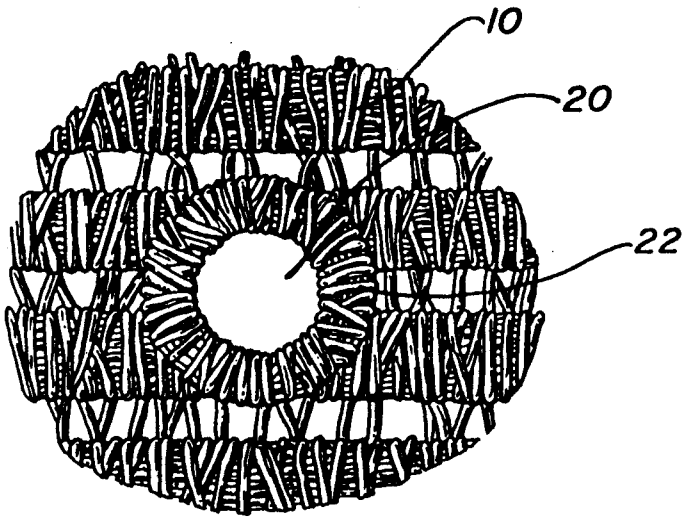
FIG. 2 is an enlarged, broken-away view of a portion of the embroidered lace bracelet shown in FIG. 1.

Referring to FIGS. 1-3, an embroidered lace bracelet, or band, generally indicated at 10, is depicted. It is to be understood that the terms bracelet and band are used interchangeably herein, and both are intended to mean a strip of material that may be placed and fastened about a portion, typically an appendage, of a body.

The embroidered lace bracelet 10 of this invention includes a first end 12 and a second end 14. Between the two ends, is design area 16 where a design is typically embroidered. Along each end, 14 and 16, are embroidered apertures 20. Each embroidered aperture is surrounded by reinforcement stitches 22. The apertures are embroidered with the embroidered lace bracelet 10 during the embroidery of the bracelet. Similarly, reinforcement stitches 22 are also embroidered with the bracelet during embroidery of the bracelet.

The embroidered lace bracelet 10 depicted in FIGS. 1-3 is designed to accept at its first end 12 a clasp means generally indicated at 30. The clasp means 30 is of the conventional buckle type fastening means comprising a clasp frame 32, a center member 34 and a pivoting pin 36 extending from center member 34. The clasp means is secured to the first end 12 of the embroidered lace bracelet 10 as follows: the first end 12 of the embroidered lace bracelet 10 is inserted into the clasp means 30 between the clasp frame 32 and the center member 34; the pivoting pin 36 is inserted into an embroidered aperture 20; the first end 12 of the embroidered lace bracelet 10 is withdrawn through the clasp means 30 between the clasp frame 32 and the center member 34 on the opposite side of center member 34 through which it was first inserted; and the first end 12 of the embroidered lace bracelet 10 is positioned back on itself and fastened securely to itself, e.g., by means of a staple or a fastening stitch, etc. Thereafter, the first end 12 of the embroidered lace bracelet 10 may be fastened to the second end 14 of the embroidered lace bracelet 10 by passage of the second end 14 through the clasp means 30 between the clasp frame 32 and the center member 34, insertion of the pivoting pin 36 into an embroidered aperture 20, and reinsertion of second end 14 through the clasping means 30 between the clasp frame 32 and the center member 34 at the side other than that through which it was first inserted, such that the second end 14 of the embroidered lace bracelet 10 overlays the first end 12 of the embroidered lace bracelet 10 as shown in FIG. 3.

Figure 4:
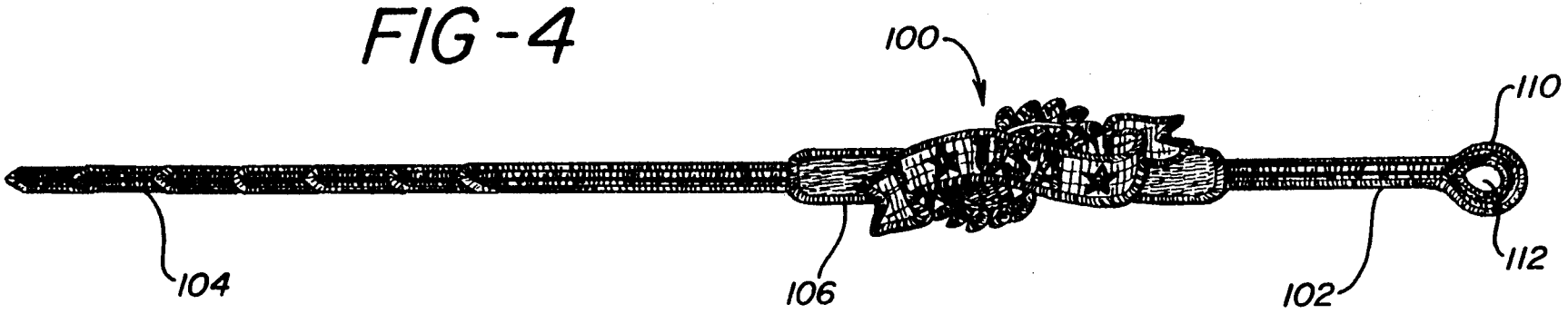
FIG. 4 is a top plan view of another embodiment of the present invention.
Figure 5:
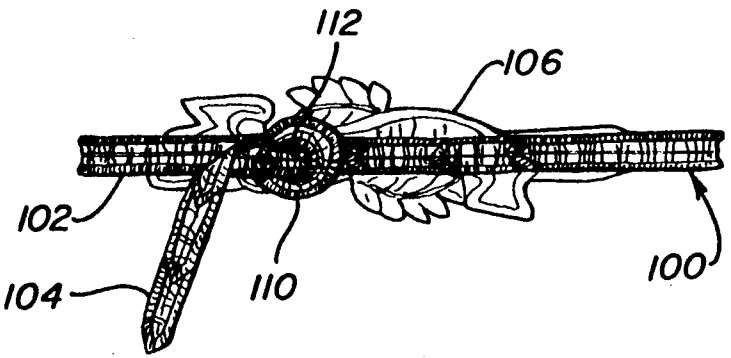
FIG. 5 is a perspective of the invention shown in FIG. 4 with the ends of the bracelet in the preliminary state of being attached.
Figure 6:
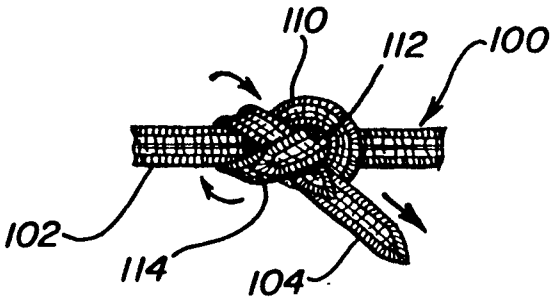
FIG. 6 is an enlarged, broken-away view of the ends of the embroidered lace bracelet of FIG. 5 in a fully attached position, the arrows indicating the motion of the second end of the bracelet during the tying thereof.

Referring to FIGS. 4–6, wherein another embodiment of the embroidered lace bracelet of the present invention is depicted. This bracelet, generally indicated at 100, comprises a first end 102, a second end 104, a thickened design area 106, an eye 110 formed on the first end 102 and an aperture 112 formed within the eye 110. All of the elements of this embroidered lace bracelet 100 including the eye 110 and the aperture 112, are embroidered with the embroidered lace bracelet 100 during the embroidery of the bracelet. The aperture 112 in eye 110 is of a size sufficient to permit the passage of second end 104 of the bracelet therethrough. Thus, this bracelet may be fastened about the wrist of a wearer by inserting the second end 104 of the bracelet 100 through the aperture 112 of eye 110 and then tying off the second end 104. This tie-off is typically effected with an overhand knot, i.e., passage of the second end 104 of the embroidered lace bracelet 100 through the aperture 112 of eye 110, then passage of the second end 104 around the inside of end 102 and then through the space defined by the outside of end 102 and the inside of end 104. See FIG. 6, wherein the arrows indicate the path that second end 104 takes to effect tie-off of the bracelet 100.

Figure 7:
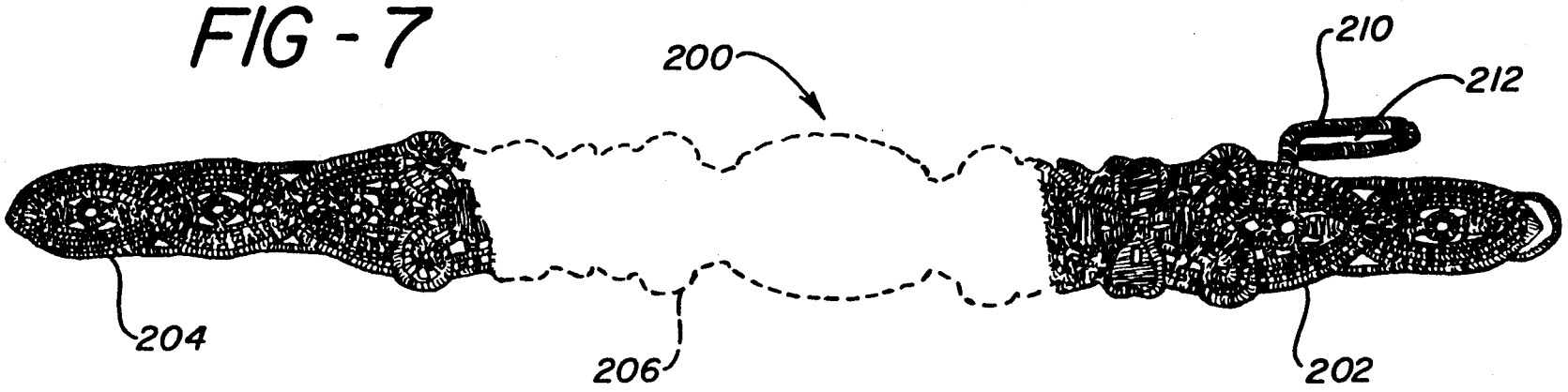
FIG. 7 shows another embodiment of the embroidered lace bracelet of the present invention.
Figure 9:
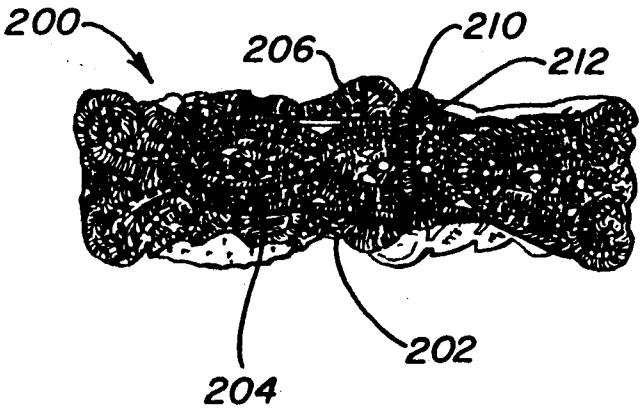
FIG. 9 is a perspective view of the embroidered lace bracelet of FIG. 7 in a fastened positioned.
Figure 8:
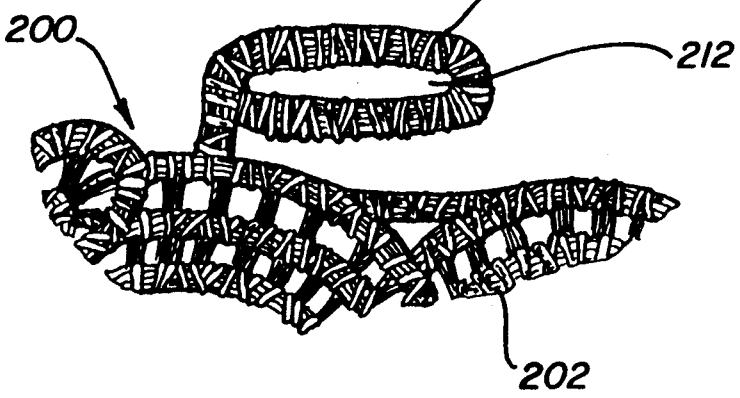
FIG. 8 shows an enlarged, broken-away view of the fastening means of the embroidered lace bracelet of FIG. 7.

Referring to FIGS. 7–9, wherein another embodiment of the embroidered lace bracelet of the present invention is depicted. The bracelet, generally indicated at 200 includes a first end 202, a second end 204, a design area 206, a loop 210 extending from the first end 202 of the embroidered bracelet 200 and an aperture 212 formed within loop 210. FIG. 8 shows the aperture 212 formed in loop 210 in great detail. Aperture 212 in loop 210 is embroidered with the embroidered lace bracelet 200 during the embroidery of the bracelet, and serves as the fastening means for fastening the bracelet about the wrist of a wearer. Fastening is effected by maneuvering the loop 210 to position the aperture 212 across the longitudinal axis, not shown, of the embroidered lace bracelet 200. When in this perpendicular position, the second end 204 of the embroidered lace bracelet 200 may be passed through the aperture 212 in loop 210 to fasten the bracelet 200 about the wrist of a wearer. Additionally, to more securely fasten the bracelet 200 about the wrist of the wearer, the first end 202 may first be inserted through the aperture 212 of loop 210 and then the second end 204 of the bracelet 200 passed therethrough.

Importantly, in all of the embodiments of the embroidered lace bracelet of the present invention, most, if not all, of the fastening means is embroidered with the embroidered lace bracelet during the embroidery of the bracelet. This serves to reduce and/or eliminate expenses associated with post-embroidery manufacture to provide a fastening means for the bracelet. Thus, the bracelets of the present invention can be manufactured for relatively low cost. Further, because the apertures embroidered into the embroidered lace bracelet are not merely punctured into the material of the bracelet, but are rather embroidered therein and reinforced during the embroidery of the embroidered lace bracelet, the apertures associated with fastening means are relatively strong, so that the fastening means of the present invention are more durable than previous fastening means.

Ideally, though not necessarily, the lace bracelets of this invention are of Schiffli embroidery and are embroidered on a Schiffli embroidery machine.

Having thus described my invention in detail, it is to be understood that the foregoing description is not intended to limit the spirit and scope thereof. What is desired to be protected by Letters Patent is set forth in the appended claims.

What is claimed is:

1. An article for attachment about a body part comprising:
   - an embroidered band having a length, and first and second ends;
   - an embroidered loop, formed during the embroidery of the band, at the first end of the band;
   - an aperture, formed during the embroidery of the band, within the embroidered loop for receiving the second end of the band;
   - the second end of the bass passing through the aperture and tied thereto to fasten the ends of the band together about a body part.

2. The article of claim 1 wherein the band has a width and the width widens intermediate the first and the second ends of the band for the embroidery of a design along the wide portion of the band.

3. The article of claim 1, wherein the band is embroidered with a lace yarn.

4. A method of manufacturing an embroidered article for attachment about a body part comprising:
   - embroidering lace yarn in the form of a band having a first end and a second end;
   - embroidering a design area intermediate of the first and second ends;
   - embroidering a loop during the embroidery of the band at the first end of the band;
   - embroidering an aperture during the embroidery of the band within the embroidered loop for receiving the second end of the band;
   - the second end of the band passing through the aperture and tied thereto to fasten the ends of the band together about a body part.

* * * * *